US005511733A

United States Patent [19]

Kalsi

[11] Patent Number: 5,511,733

[45] Date of Patent: Apr. 30, 1996

[54] NEGATIVE RADIUS COIL WINDERS

[75] Inventor: Swarm S. Kalsi, Pt. Salonga, N.Y.

[73] Assignee: Northrop Grumman Corporation, Los Angeles, Calif.

[21] Appl. No.: 200,486

[22] Filed: Feb. 23, 1994

[51] Int. Cl.[6] ..... B65H 81/00; H01B 11/04; H01F 7/06

[52] U.S. Cl. ..... 242/437.3; 29/605; 140/92.2; 242/443

[58] Field of Search ..... 242/7.01, 7.03, 242/7.14; 29/605; 140/92.1, 92.2

[56] References Cited

U.S. PATENT DOCUMENTS 4,448,054 5/1984 Wayne ..... 29/605 X
4,547,238 10/1985 Lenders ..... 140/92.2 X
4,694,868 9/1987 Jahnke et al. ..... 29/605 X
4,709,470 12/1987 Meier ..... 29/605
4,839,585 6/1989 Bicknell ..... 29/605 X
4,947,543 8/1990 Kawazoe et al. ..... 29/605
5,065,496 11/1991 Jarabak et al. ..... 29/605 X

*Primary Examiner*—Michael R. Monsen
*Attorney, Agent, or Firm*—Terry J. Anderson; Karl J. Hoch, Jr.

[57] ABSTRACT

A banana shaped coil, including a convex (positive radius) surface and opposite concave (negative radius) surface is wound by applying winding wire against the negative radius surface. The winding apparatus is provided with an apparatus for sequentially engaging a trailing edge of the winding wire being applied so as to maintain it in tension against the negative radius surface. The device is disengaged when the winding wire becomes applied against the positive radius surface, since the contour of this surface naturally tensions the winding.

2 Claims, 3 Drawing Sheets

NEGATIVE RADIUS COIL WINDERS

FIELD OF THE INVENTION

The present invention relates to coil winding apparatus, and more particularly to such an apparatus capable of winding a metal coil around a concave (negative radius) surface.

BACKGROUND OF THE INVENTION

Many scientific devices such as synchrotrons employ coils having a concave surface (negative radius side). In such a coil, a part of the coil circumference lies on a negative radius. No suitable or efficient technique exists to enable winding of such coils under tension.

BRIEF DESCRIPTION OF THE PRESENT INVENTION

The present invention is directed to two principle embodiments for winding a coil, under tension, around a core having a banana shaped cross section. As such, the coil must accommodate two arcuate surfaces, one of which has a positive radius and the other a negative radius. In each of the embodiments, a winding arm cams a supply wire against the negative radius cross surface while trailing retention devices maintain the wound wire against the negative radius surface.

In a basic first embodiment of the invention, the retention devices take the form of manually inserted pins. In the second more automated embodiment, the retention devices are a series of spring biased rollers which urge the supplied wire against the negative radius surface as the coil is being wound.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
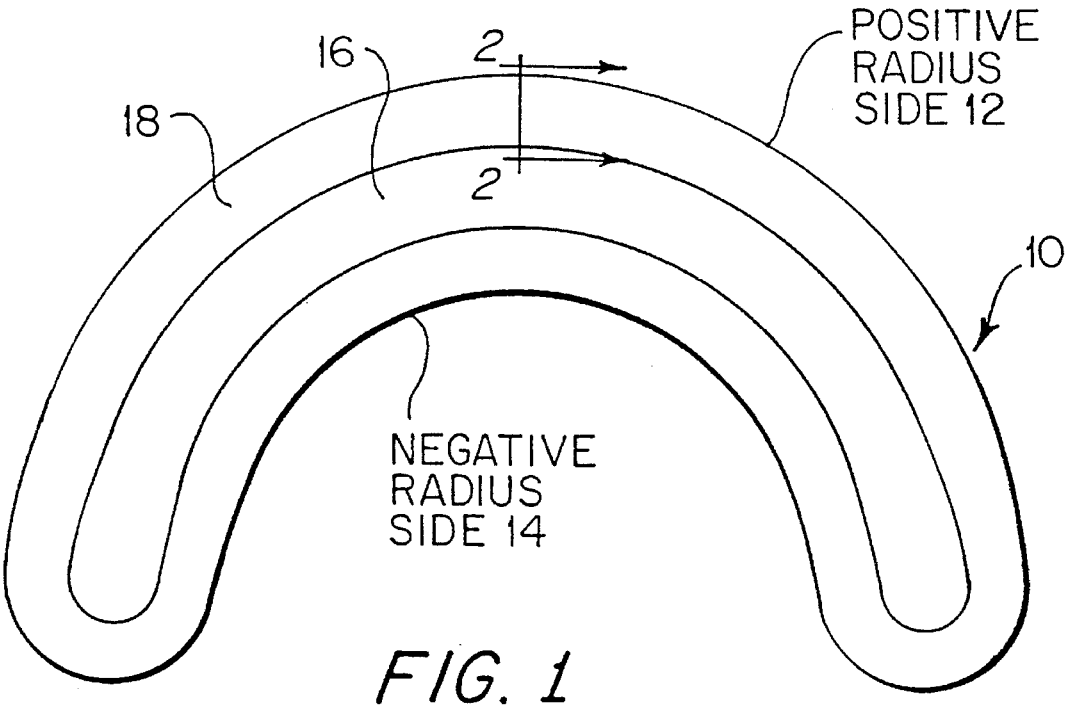
FIG. 1 is a top plan view of a banana shaped coil having a negative radius surface which results from employment of the present invention.
Figure 2:
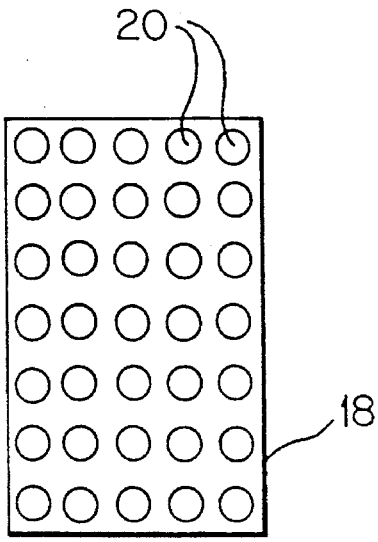
FIG. 2 is a cross sectional view taken along section line 2—2 of FIG. 1.

In FIG. 1, a banana shaped coil is shown, this coil being made by implementing the present invention. The completed coil is generally indicated by reference numeral 10 and is seen to include a first arcuate convex surface—or positive radius side 12. Opposite this side is a concave surface—or negative radius side 14. A central banana shaped metal core 16 forms the central support for externally wound wires 18 which conform to the banana shape and are shown in cross section in FIG. 2.

Figure 3:
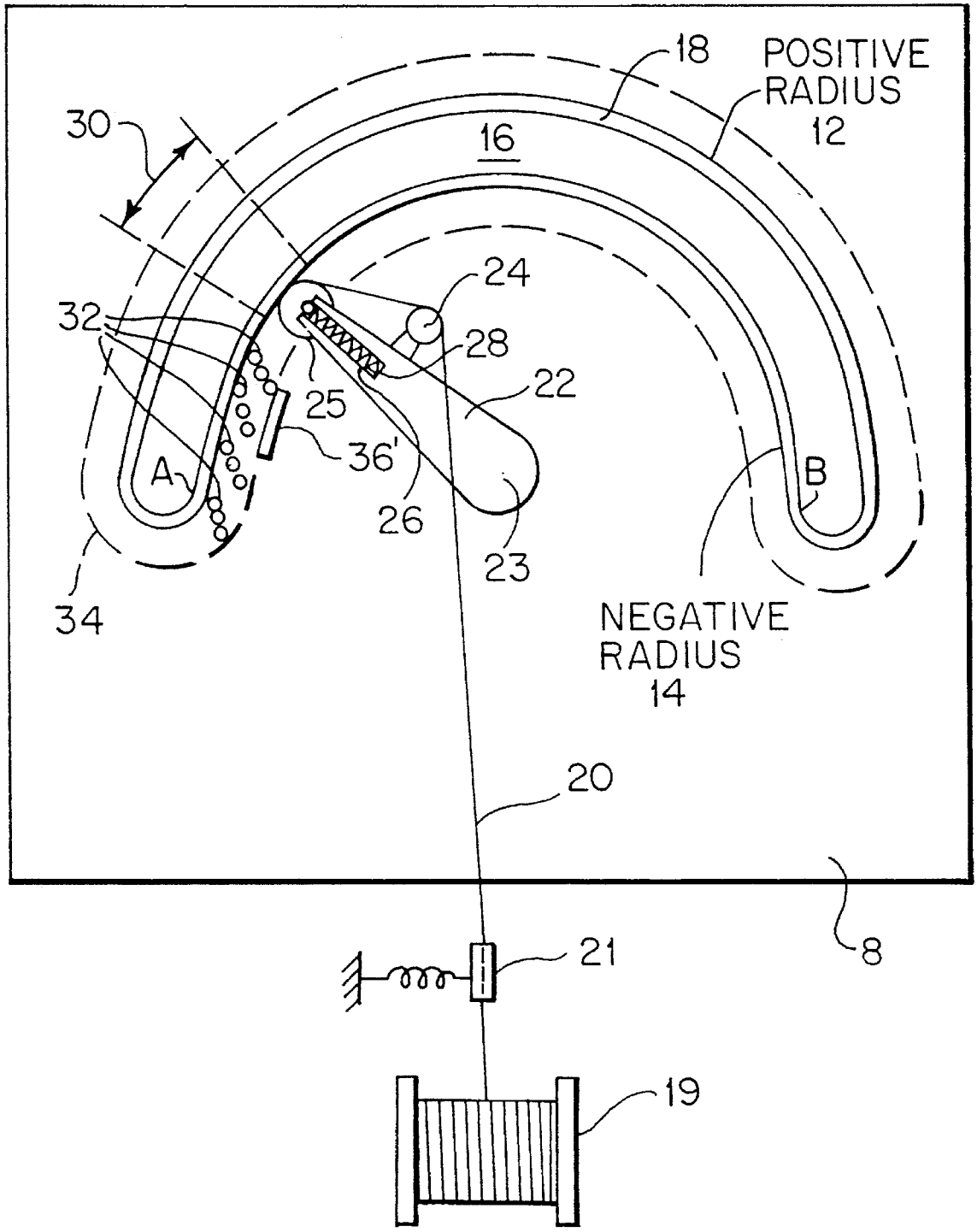
FIG. 3 is a top plan view of the first embodiment of the present invention.

FIG. 3 illustrates a first embodiment of the present invention—this embodiment being more basic and manual than the second embodiment to be discussed. A base plate 8 secures the banana shaped upright core 16 in orthogonal relationship by means of suitable fasteners (not shown). A supply reel 19 is positioned adjacent the base plate and supplies wire 20 which shall form the windings of the coil. The tensioning device 21 is located along an intermediate length of the wire 20. A teflon roller 24 is mounted on an axis perpendicular to the base plate 8 and serves as a guide for the supplied wire 20. A winding arm 22 has a rotational axis 23 mounted at a first end thereof and extending perpendicularly to the base plate 8. The outward end of the arm 22 includes Teflon roller 25 which rolls or cams the supplied wire 20 against the concave or negative radius surface 14. In order to maintain the wire 20 against the negative radius surface 14, the roller 25 is biased outwardly by a spring 28 that is positioned within a slot 26, longitudinally formed along the outer section of the arm 22. A top plate shown in phantom lines 34 is preferably made of clear plastic and may be banana shaped to conform with the coil being wound. This cover is removably secured in an appropriate manner to the core 16 and serves to retain the windings on the core as well as providing a support for retention pins to be presently discussed.

Viewing FIG. 3, the winding arm 22 rotates in a clockwise direction across the entire negative radius surface 14. For each segment of rotation, as indicated by reference numeral 30, the corresponding length of winding is applied, in tension, to the negative radius 14. The winding arm 22 is moved in increments equal to the segment 30. After each segmental displacement, a pin 32 is lowered through an appropriately positioned hole in cover 34 so as to urge the winding segment against the negative radius surface 14. In FIG. 3, a first line of four pins are shown resting against the winding being applied thereby maintaining the winding tension. The sequence of incrementally winding segments of wire 20 and positioning pins 32 along the trailing edges, of the winding being formed, continues across the entire negative radius surface 14, roughly between indicated points A and B. Between these points, an entire length of winding has been applied to the negative radius 14. At point B, the winding arm 22 is locked into place and the base plate 8 is rotated clockwise so that the winding may continue on the opposite surface or positive radius surface 12—from point B for return to point A. No pins need be applied during the winding across the positive radius 12 since that surface naturally causes tensioning of the winding. Once the winding has reached point A, in preparation or a new transversal of the negative radius surface 14, the previously inserted pins 32 are sequentially removed a segment at a time so that they do not interfere with the approaching roller 25, thereby permitting roller 25 to press applied winding wire 20 against the previously deposited winding. However, as each angular segment of winding is applied, the next arcuate row of pins are placed through the top plate 34, along the trailing edge (or just applied) winding segment. During the winding of the negative radius surface, the base plate 8 is clamped to prevent its rotation.

The depositing of the winding then continues, again, to point B when the winding arm 22 is again clamped and the base plate 8 is rotated clockwise to deposit a subsequent winding across the positive radius 12—without the aid of pins 32. Upon completion of the winding, retaining collars 36' are installed in small angular segments. Once the retaining collars have been installed and the winding arm 22 is removed, the winding base plate 8 and the resulting coil can be prepared for further processing—such as coating with heat sensitive insulating tape or epoxy impregnation.

Figure 4:
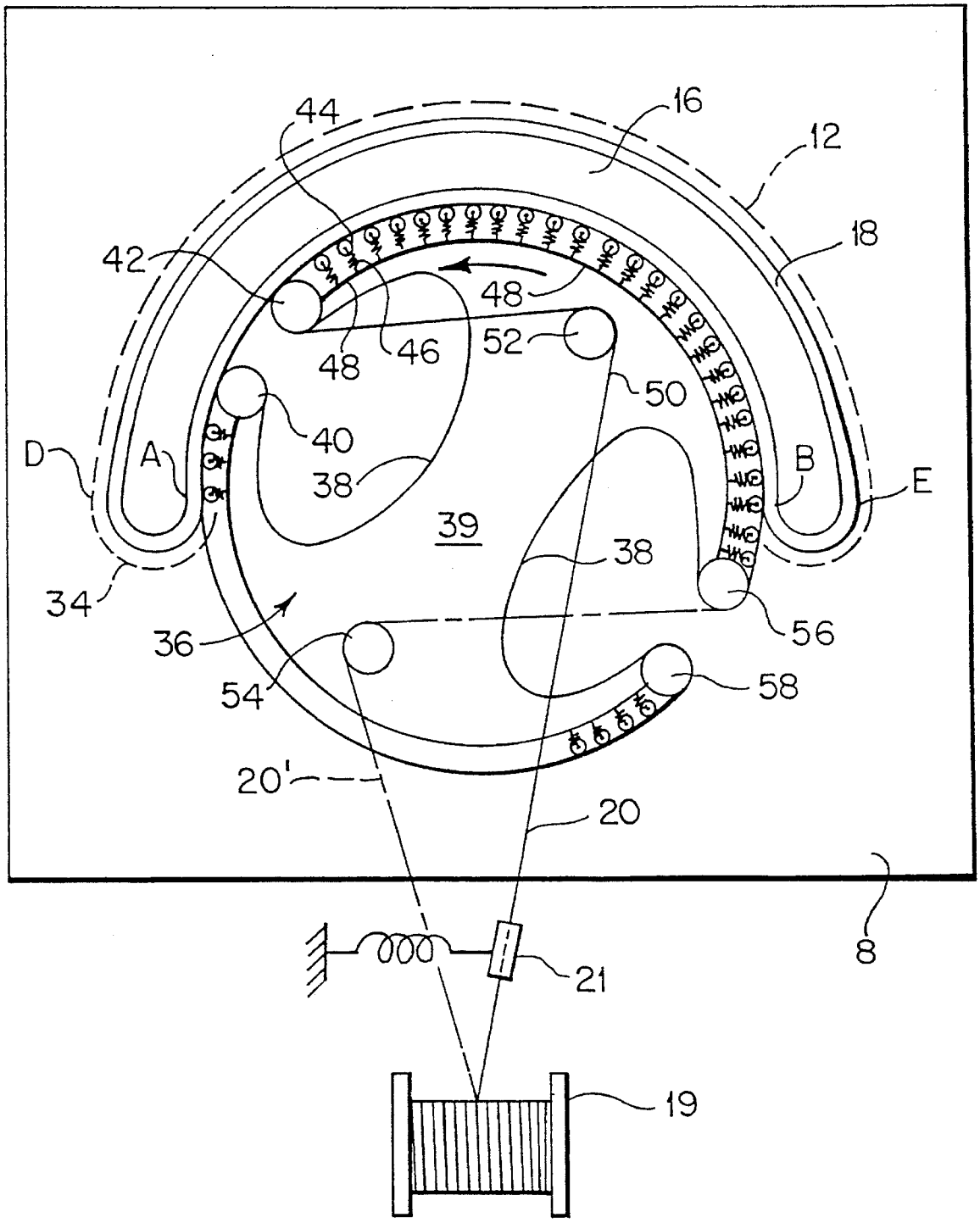
FIG. 4 is a top plan view of the second embodiment of the present invention.

FIG. 4 illustrates a second embodiment—which eliminates the need for manually inserting pins, sequentially. In lieu of a winding arm 22, the embodiment of FIG. 4 includes a winding wheel 36 that has a central axis of rotation and includes two oblong cut outs 38 at diametrically opposite areas thereby creating a central web in the winding wheel 36. A first Teflon roller 40 is positioned at the illustrated lower edge of the cut out 38—a similar roller 42 being mounted at the opposite cut out edge. At the point of a winding cycle shown in FIG. 4, roller 42 cams or rolls winding wire 20 against the negative radius surface of the core 16. Teflon roller 52, mounted on web 39, serves as guide for the wire 20 prior to being positioned between roller 42 and the core 16. In FIG. 4, the winding wheel 36 is assumed to undergo counter clockwise rotation. A first series of smaller Teflon rollers 44 are mounted over nearly one half of the rim of winding wheel 36. Each roller 44 is connected to the rim of the winding wheel 36 by means of an individual spring 46. The springs maintain the rollers in outward biasing relationship to a winding being deposited against the negative radius of the core. The pressure applied by these rollers will be along the trailing length of the applied winding so that they accomplish the same result as the pins 32 of the first embodiment (FIG. 3). When roller 42 reaches point A, the winding wheel 36 is secured and the wire 20 is removed from roller 52. The base plate 8 is rotated in a counter clockwise direction so as to continue to apply the winding to the positive radius surface of the core 16. As in the case of the first embodiment, no retention means need be applied against the winding across the surface of the positive radius since this naturally maintains the applied winding in tension. After the base plate 8 has been rotated 180° and the winding is applied across the positive radius surface from point A to point B—the base plate 8 is secured and the winding wheel 36 is released. The winding wheel is now prepared to apply a winding across the negative radius surface from point B to point A. Two Teflon rollers 56 and 58 (comparable to 40, 42) become operational during this portion of the winding cycle. Specifically, wire 20 is wound around a Teflon roller 54 which is diametrically located, relative to roller 52, on web 39. The wire (20') is entrained around roller 54 and roller 56. As the winding wheel 36 is rotated counter clockwise, the wire is then engaged by roller 58 which cams or pushes a supply length of wire against the negative radius of core 16 to complete a subsequent winding on this negative radius surface.

As indicated in FIG. 4, additional rollers 44 exist along the lower wheel rim to perform the same wire tensioning of the winding being applied to the core. This continues until roller 56 is rotated from point B to point A at which time the winding wheel is again secured and the plate 8 rotated to apply a subsequent winding to the positive radius surface of the core.

After the wheel 36 is secured, the wire 20 is removed from roller 52 so that the wire is free to be wound across the positive radius surface of the core 16.

After the coil has been wound, retaining collars may be employed, such as previously discussed in connection with the first embodiment. Once this has been accomplished, the winding arm may be removed and the coil may be prepared for further processing as previously mentioned.

Figure 5:
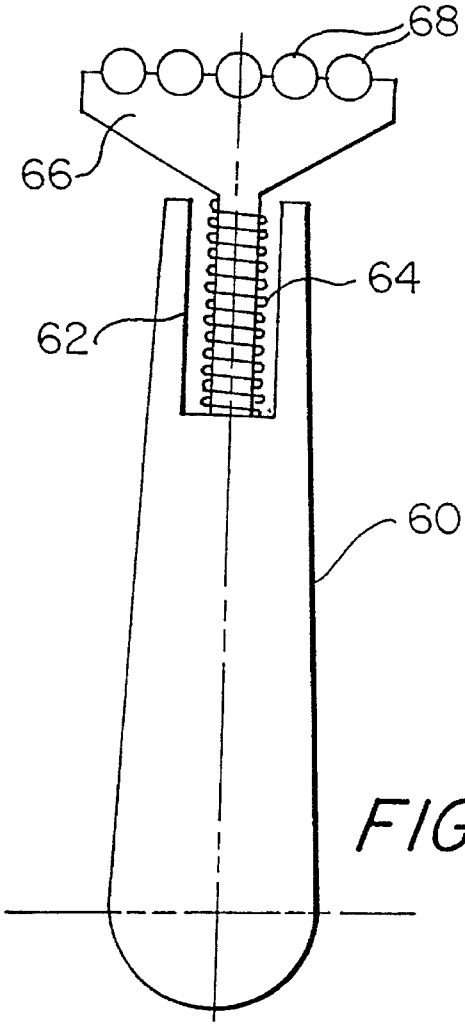
FIG. 5 is a plan view of a multiple roller head for laying wire by the first embodiment of the invention.

FIG. 5 illustrates a variation of the arm relative to the first embodiment of FIG. 3. As indicated, a winding arm 60 includes a recess 62 formed at an outer end thereof for receiving spring 64. However, rather than the spring biasing a single roller, a multiple roller head is employed—including a mounting plate 66 having a stem extending through the spring 64 and multiple in-line rollers 68 positioned along the outer edge of plate 66.

It should also be mentioned that although the biasing of rollers for this invention has been discussed in terms of springs, other types of devices may be employed such as miniature conventional hydraulic actuators.

It should be understood that the invention is not limited to the exact details of construction shown and described herein for obvious modifications will occur to persons skilled in the art.

I claim:

1. A winding apparatus capable of forming a coil on a surface of a negative radius, comprising:

means for supplying wire for the coil;

roller means for applying a length of wire to the negative radius surface;

means for urging the applied wire against points on the surface as the roller means passes the points, and maintaining the applied wire thereagainst;

wherein the urging means comprises:

a plate located perpendicular to the axis of the coil and in spaced overlying relation to the surface, the plate having a series of arcuate rows of holes, the rows having successively decreasing radii; and a plurality of pins to be sequentially positioned in the holes, behind a traversal path of the roller means and in contact with the applied wire to prevent separation of the applied wire and the surface.

2. A winding apparatus capable of forming a coil on a banana-shaped core having opposite surfaces of negative and positive radii, comprising:

means for supplying wire for the coil;

roller means for applying a length of wire to the negative radius surface;

means for urging the applied wire against points on the surface as the roller means passes the points, and maintaining the applied wire thereagainst;

means for selectively rotating the roller means across a stationary negative radius surface;

support means for selectively rotating the core relative to the roller means when the surface of positive radius passes the roller means, simultaneous with securement of the roller means;

wherein the urging means comprises:

a plate located perpendicular to the axis of the coil and in spaced overlying relation to the surface, the plate having a series of arcuate rows of holes, the rows having successively decreasing radii; and a plurality of pins to be sequentially positioned in the holes, behind a traversal path of the roller means, and in contact with the applied wire, to prevent separation of the applied wire and the surface.

* * * * *